US008947336B2

(12) United States Patent
Chou et al.

(10) Patent No.: US 8,947,336 B2
(45) Date of Patent: Feb. 3, 2015

(54) DISPLAY DRIVING METHOD WITH VARIABLE SCAN DRIVING SIGNAL, DRIVING MODULE WITH VARIABLE SCAN DRIVING SIGNAL, AND DISPLAY APPARATUS WITH VARIABLE SCAN DRIVING SIGNAL

(75) Inventors: Cheng-Hsu Chou, Miao-Li County (TW); Ming-Chun Tseng, Miao-Li County (TW); Hong-Ru Guo, Miao-Li County (TW)

(73) Assignees: Innocom Technology (Shenzhen) Co., Ltd., Shenzhen, Guangdong Province (CN); InnoLux Corporation, Miao-Li County (TW)

( * ) Notice: Subject to any disclaimer, the term of this patent is extended or adjusted under 35 U.S.C. 154(b) by 121 days.

(21) Appl. No.: 13/608,679

(22) Filed: Sep. 10, 2012

(65) Prior Publication Data

US 2013/0147856 A1 Jun. 13, 2013

(30) Foreign Application Priority Data

Dec. 9, 2011 (TW) ..... 100145614 A

(51) Int. Cl.
*G09G 3/36* (2006.01)

(52) U.S. Cl.
USPC ..... 345/99

(58) Field of Classification Search
CPC ..... G09G 2310/0248; G09G 2310/0251
USPC ..... 345/212, 213, 98–100, 55
See application file for complete search history.

(56) References Cited

U.S. PATENT DOCUMENTS

2002/0024486 A1* 2/2002 Aoki ..... 345/87
2009/0009498 A1* 1/2009 Nishimura ..... 345/205

FOREIGN PATENT DOCUMENTS

TW 200933568 A 8/2009
TW 201037675 A1 10/2010

* cited by examiner

*Primary Examiner* — Chanh D. Nguyen
*Assistant Examiner* — Ram Mistry
(74) *Attorney, Agent, or Firm* — Muncy, Geissler, Olds & Lowe, P.C.

(57) ABSTRACT

A display driving method comprises the steps of: determining a first target-level voltage and a second target-level voltage of a signal of the scan line; determining a first switch time and a second switch time according to an RC loading of the scan line; determining at least one first precharge-level voltage and at least one second precharge-level voltage according to the first target-level voltage, the second target-level voltage, the first switch time, and the second switch time; and outputting the first precharge-level voltage, the first target-level voltage, the second precharge-level voltage, and the second target-level voltage to drive the display panel, wherein the first precharge-level voltage is switched to the first target-level voltage after the first switch time, and the second precharge-level voltage is switched to the second target-level voltage after the second switch time.

18 Claims, 6 Drawing Sheets

| multiple of RC | $\triangle V(t) = (V(t)-V_i) / (V_f - V_i)$ |
|---|---|
| 0.0 | 0.00% |
| 0.5 | 39.35% |
| 1.0 | 63.21% |
| 1.5 | 77.69% |
| 2.0 | 86.47% |
| 4.0 | 98.17% |
| 6.0 | 99.75% |
| 8.0 | 99.97% |
| 10.0 | 100.00% |

DISPLAY DRIVING METHOD WITH VARIABLE SCAN DRIVING SIGNAL, DRIVING MODULE WITH VARIABLE SCAN DRIVING SIGNAL, AND DISPLAY APPARATUS WITH VARIABLE SCAN DRIVING SIGNAL

CROSS REFERENCE TO RELATED APPLICATIONS

This Non-provisional application claims priority under 35 U.S.C. §119(a) on Patent Application No(s). 100145614 filed in Taiwan, Republic of China on Dec. 9, 2011, the entire contents of which are hereby incorporated by reference.

BACKGROUND OF THE INVENTION

1. Field of Invention

The invention relates to a display driving method, a driving module, and a display apparatus and, in particular, to a display driving method, a driving module, and a display apparatus of an active matrix type.

2. Related Art

The flat display apparatuses, which have advantages such as low power consumption, less heat, light weight and non-radiation, have been widely applied to various electronic products and gradually take the place of the cathode ray tube (CRT) display apparatus.

The flat display apparatus can be divided into a passive matrix type and an active matrix type according to the driving method thereof. However, the passive matrix display apparatus is confined to such driving method that it has drawbacks such as short lifecycle and can not be manufactured as large size. Although the active matrix display apparatus has a higher cost and a more complicated manufacturing process, it can be manufactured as large size and full color with high definition, already becoming a mainstream of the flat display apparatuses.

FIG. 1A is a schematic diagram of a conventional active matrix display apparatus 1. As shown in FIG. 1, the display apparatus 1 includes a display panel 11 and a driving module 12 having a scan driving circuit 121 and a data driving circuit 122. The scan driving circuit 121 is electrically connected with the display panel 11 through a plurality of scan lines Sm, and the data driving circuit 122 is electrically connected with the display panel 11 through a plurality of data lines Dn. The display panel 11 includes a plurality of pixels (not shown), which are defined by the intersected data lines Dn and scan lines Sm. When the scan driving circuit 121 outputs scan signals to the scan lines Sm sequentially, the data driving circuit 122 outputs the data signals corresponding to each row of the pixels to the pixel electrodes of the pixels through the data lines Dn, thereby making the display panel 11 display images.

A scan time of each scan line is mainly determined by the number of the scan lines and the display frequency. However, some parasitic capacitances are formed by the crossover of the data lines, and besides, parasitic capacitances (e.g. Cgd, Cgs, Csd) of the transistors and the loading impedance exist in the pixel array of the display panel 11. Hence, an ideal scan signal waveform A as shown in FIG. 1B will be delayed and deformed to become another waveform B. The problem of signal delay and deformation will be getting more serious with the large-size, high definition, and 3D display apparatus, and may cause the sampling error of the pixel signals so that the display panel 11 can not display normally.

Therefore, it is an important subject to provide a display driving method, a driving module, and a display apparatus that can solve the scan signal delay problem, and decrease the power consumption and the stress effect of the pixel switch devices.

SUMMARY OF THE INVENTION

In view of the foregoing subject, an objective of the invention is to provide a display driving method, a driving module, and a display apparatus that can solve the scan signal delay problem, and decrease the power consumption and the stress effect of the pixel switch devices.

To achieve the above objective, the invention discloses a display driving method for driving a display panel by at least one scan line. The display driving method comprises the steps of: determining a first target-level voltage and a second target-level voltage of a signal of the scan line; determining a first switch time and a second switch time according to an RC loading of the scan line; determining at least one first precharge-level voltage and at least one second precharge-level voltage according to the first target-level voltage, the second target-level voltage, the first switch time, and the second switch time; and outputting the first precharge-level voltage, the first target-level voltage, the second precharge-level voltage, and the second target-level voltage to drive the display panel, wherein the first precharge-level voltage is switched to the first target-level voltage after the first switch time, and the second precharge-level voltage is switched to the second target-level voltage after the second switch time.

In one embodiment, the first target-level voltage and the second target-level voltage are determined according to gray level voltages driving the pixels of the display panel, the first target-level voltage is higher than the highest gray level voltage by at least one threshold voltage, and the second target-level voltage is lower than the lowest gray level voltage by at least one threshold voltage.

In one embodiment, the first precharge-level voltage is higher than the first target-level voltage, and the second precharge-level voltage is lower than the second target-level voltage.

In one embodiment, the time constant of the scan line is generated according to the RC loading of the scan line, to determine the first switch time and the second switch time.

In one embodiment, one of the first precharge-level voltage, the first target-level voltage, the second precharge-level voltage, and the second target-level voltage is output at one time.

To achieve the above objective, the invention also discloses a driving module for driving a display panel by at least one scan line, which comprises a scan driving circuit, a detection circuit, and a scan signal generating circuit. The scan driving circuit outputs a scan driving signal to drive the display panel, wherein the scan driving signal has at least one first precharge-level voltage and a first target-level voltage, and the first precharge-level voltage is switched to the first target-level voltage after a first switch time. The detection circuit detects an RC loading of the scan line to determine the first switch time. The scan signal generating circuit is electrically connected with the scan driving circuit and the detection circuit and controls the scan driving circuit to output the scan driving signal, wherein the scan signal generating circuit determines the first precharge-level voltage according to the first target-level voltage and the first switch time.

In one embodiment, the first target-level voltage is determined according to gray level voltages driving the pixels of the display panel, and the first target-level voltage is higher than the highest gray level voltage by at least one threshold voltage.

In one embodiment, the detection circuit generates the time constant of the scan line according to the RC loading of the scan line, to determine the first switch time.

In one embodiment, the scan driving signal further includes at least one second precharge-level voltage and a second target-level voltage, and the second precharge-level voltage is switched to the second target-level voltage after a second switch time.

In one embodiment, the scan signal generating circuit determines the second precharge-level voltage according to the second target-level voltage and the second switch time.

In one embodiment, the second target-level voltage is lower than the lowest gray level voltage by at least one threshold voltage, the highest gray level voltage is the highest gray level voltage of a frame, and the lowest gray level voltage is the lowest gray level voltage of the frame.

In one embodiment, the first precharge-level voltage is higher than the first target-level voltage, and the second precharge-level voltage is lower than the second target-level voltage.

To achieve the above objective, the invention further discloses a display apparatus, which comprises a display panel and a driving module. The driving module drives the display panel by at least one scan line and comprises a scan driving circuit, a detection circuit, and a scan signal generating circuit. The scan driving circuit outputs a scan driving signal to drive the display panel, wherein the scan driving signal has at least one first precharge-level voltage and a first target-level voltage, and the first precharge-level voltage is switched to the first target-level voltage after a first switch time. The detection circuit detects an RC loading of the scan line to determine the first switch time. The scan signal generating circuit is electrically connected with the scan driving circuit and the detection circuit and controls the scan driving circuit to output the scan driving signal, wherein the scan signal generating circuit determines the first precharge-level voltage according to the first target-level voltage and the first switch time.

In one embodiment, the first target-level voltage is determined according to gray level voltages driving the pixels of the display panel, and the first target-level voltage is higher than the highest gray level voltage by at least one threshold voltage.

In one embodiment, the detection circuit generates the time constant of the scan line according to the RC loading of the scan line, to determine the first switch time.

In one embodiment, the scan driving signal further includes at least one second precharge-level voltage and a second target-level voltage, and the second precharge-level voltage is switched to the second target-level voltage after a second switch time.

In one embodiment, the scan signal generating circuit determines the second precharge-level voltage according to the second target-level voltage and the second switch time.

In one embodiment, the second target-level voltage is lower than the lowest gray level voltage by at least one threshold voltage, the highest gray level voltage is the highest gray level voltage of a frame, and the lowest gray level voltage is the lowest gray level voltage of the frame.

In one embodiment, the scan driving circuit outputs one of the first precharge-level voltage, the first target-level voltage, the second precharge-level voltage, and the second target-level voltage at one time.

In one embodiment, the first precharge-level voltage is higher than the first target-level voltage, and the second precharge-level voltage is lower than the second target-level voltage.

As mentioned above, in the display driving method, the driving module and the display apparatus of the invention, a first switch time and a second switch time are determined according to the RC loading of the scan line. Besides, a first precharge-level voltage and a second precharge-level voltage are determined according to the first target-level voltage, the second target-level voltage, the first switch time, and the second switch time. Then, the first precharge-level voltage, the first target-level voltage, the second precharge-level voltage, and the second target-level voltage are output to drive the display panel. The first precharge-level voltage is switched to the first target-level voltage after the first switch time, and the second precharge-level voltage is switched to the second target-level voltage after the second switch time. Accordingly, the scan driving signal can be driven rapidly to the target-level voltage, thereby reducing the charging and discharging time of the scan line's loading and diminishing the scan line's signal delay. Besides, because the scan driving signals for driving the pixels of the display panel are not fixed to a level as high as the prior art, the power consumption and the stress effect of the pixel switch devices (such as transistors) can be decreased in the display apparatus of the invention.

BRIEF DESCRIPTION OF THE DRAWINGS

The invention will become more fully understood from the detailed description and accompanying drawings, which are given for illustration only, and thus are not limitative of the present invention, and wherein.

DETAILED DESCRIPTION OF THE INVENTION

The present invention will be apparent from the following detailed description, which proceeds with reference to the accompanying drawings, wherein the same references relate to the same elements.

Thereinafter, the display apparatus 4 and the driving module 2 of the invention will be first illustrated, and then the display driving method of the invention will be illustrated.

Figure 1A:
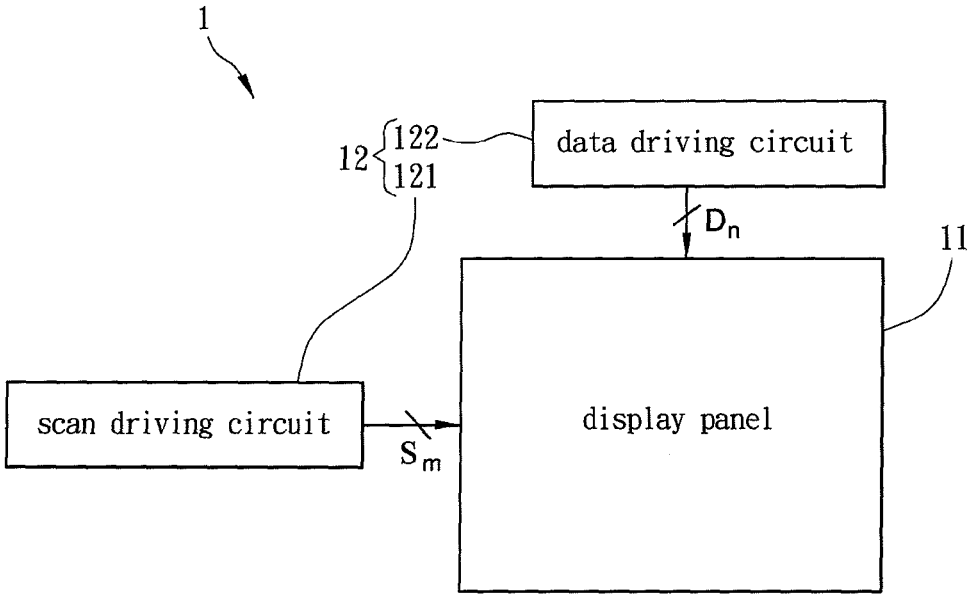
FIG. 1A (Prior Art)
FIG. 1A is a schematic diagram of a conventional active matrix display apparatus.
Figure 1B:
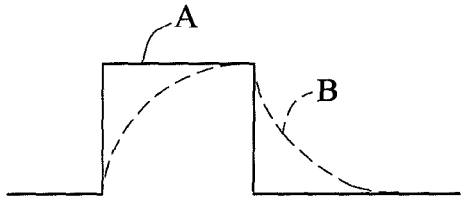
FIG. 1B (Prior Art)
FIG. 1B is a schematic diagram of a waveform of a scan signal.
Figure 2:
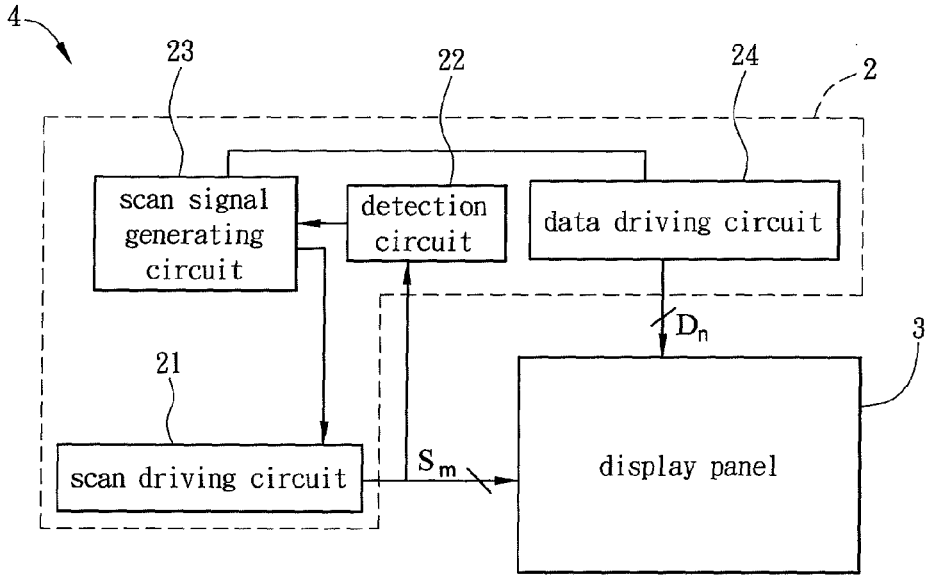
FIG. 2 is a schematic block diagram of a display apparatus according to a preferred embodiment of the invention.
Figure 3:
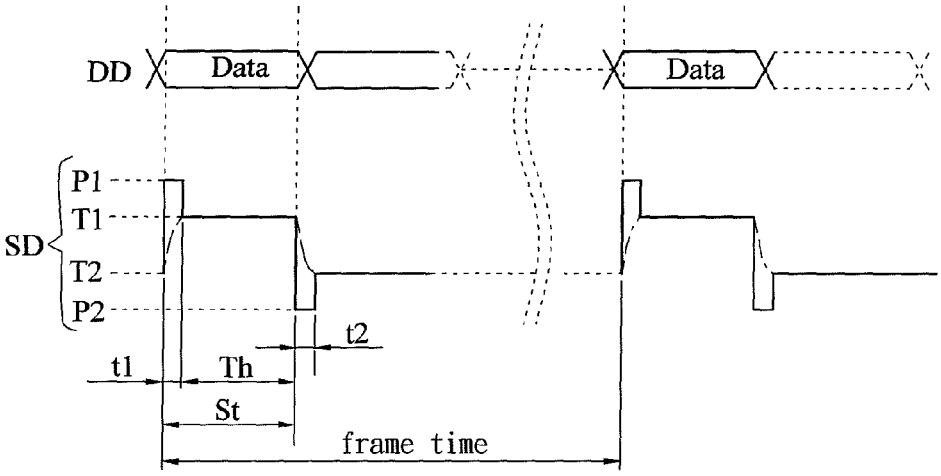
FIG. 3 is a schematic diagram of driving signals of the display panel as shown in FIG. 2.

FIG. 2 is a schematic block diagram of a display apparatus 4 according to a preferred embodiment of the invention, and FIG. 3 is a schematic diagram of driving signals of the display panel 3 as shown in FIG. 2.

As shown in FIGS. 2 and 3, the display apparatus 4 includes a driving module 2 and a display panel 3. To be noted, the display apparatus is instanced as an active matrix display apparatus, such as an active matrix LCD (liquid crystal display) apparatus or an active matrix OLED (organic light-emitting diode) display apparatus. Besides, the display apparatus 4 can be a high definition or a 3D display apparatus, such as a full high definition (FHD) and so-called 4K2K (3840*2160) display apparatus.

The display panel 3 includes at least one pixel. The driving module 2 drives the display panel 3 by at least one scan line and at least one data line. In the embodiment, the display apparatus 4 is instanced as having a plurality of pixels (not shown in FIG. 2), a plurality of scan lines Sm, and a plurality of data lines Dn. The scan lines Sm and the data lines Dn are intersected to define the pixel array including the pixels. The display panel 3 is electrically connected with the driving module 3 by the scan lines Sm and the data lines Dn.

The driving module 2 includes a scan driving circuit 21, a detection circuit 22, and a scan signal generating circuit 23. The driving module 2 can further include a data driving circuit 24. The scan driving circuit 21 is electrically connected with the display panel 3 through the scan lines Sm, and the data driving circuit 24 is electrically connected with the display panel 3 through the data lines Dn. As shown in FIGS. 2 and 3, when the scan driving circuit 21 outputs scan driving signals SD to turn on the scan lines Sm sequentially, the data driving circuit 24 outputs the data signals DD corresponding to each row of the pixels to the pixels through the data lines Dn, thereby making the display panel 3 display images.

The scan driving signal SD includes at least one first precharge-level voltage P1 and a first target-level voltage T1. The first precharge-level voltage P1 is higher than the first target-level voltage T1, and the first precharge-level voltage P1 is switched to the first target-level voltage T1 after a first switch time t1. Furthermore, the scan driving signal SD includes at least one second precharge-level voltage P2 and a second target-level voltage T2. The second precharge-level voltage P2 is lower than the second target-level voltage T2, and the second precharge-level voltage P2 is switched to the second target-level voltage T2 after a second switch time t2. In the embodiment, the first target-level voltage T1 can serve as the high level voltage of the scan driving signal SD for turning on, and the second target-level voltage T2 can serve as the low level voltage of the scan driving signal SD for turning off. In the embodiment as shown in FIG. 3, the scan driving signal SD is instanced as having a single first precharge-level voltage P1 and a single second precharge-level voltage P2, but in other embodiments, the scan driving signal SD can have one or more first precharge-level voltages P1 and one or more second precharge-level voltages P2.

The following is the clear illustration of how to determine the first precharge-level voltage P1, the second precharge-level voltage P2, the first target-level voltage T1, the second target-level voltage T2, the first switch time t1, and the second switch time t2.

The first target-level voltage T1 and the second target-level voltage T2 are determined according to the gray level voltage driving the pixels of the display panel 3, and in other words, according to the gray level voltage of the data driving signal DD driving the display panel 3. The first target-level voltage T1 can be higher than the highest gray level voltage by at least one threshold voltage. The second target-level voltage T2 can be lower than the lowest gray level voltage by at least one threshold voltage. Herein, the highest gray level voltage is the highest gray level voltage of a frame, and the lowest gray level voltage is the lowest gray level voltage of a frame.

In detail, the first target-level voltage T1 and the second target-level voltage T2 are changeable, determined according to the data driving signals DD corresponding to each row of the pixels, or a certain area's pixels, or the whole pixels. For example, in a certain frame, the data driving signal DD corresponding to a certain row of pixels includes the highest gray level voltage 5V and the lowest gray level voltage −3V among the whole gray level voltages. Hence, the scan driving signal SD driving the certain row of pixels can have the first target-level voltage T1 determined as higher than the highest gray level voltage (5V for example) by at least one threshold voltage, and have the second target-level voltage T2 determined as lower than the lowest gray level voltage (−3V for example) by at least one threshold voltage. So, the first target-level voltage T1 can be determined as 7V for example, and the second target-level voltage T2 can be determined as −5V for example. To be noted, the first target-level voltage T1 and the second target-level voltage T2 can be varied and determined according to the practical requirement. Besides, because the data driving signals DD for driving the pixels corresponding to the different scan lines maybe have the same or different highest gray level voltage, the scan driving signals SD of the different scan lines thus have the same or different first target-level voltage T1 and second target-level voltage T2. Accordingly, because the scan driving signals SD for driving the pixels of the display panel 3 is not fixed to a level as high as the prior art, the power consumption and the stress effect of the pixel switch devices (such as transistors) can be decreased in the invention.

Figure 4A:
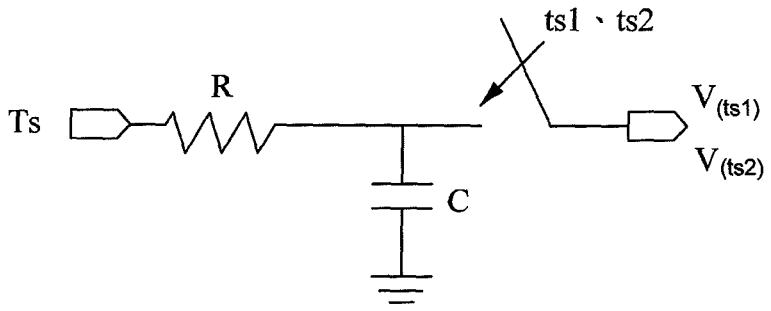
FIG. 4A is a schematic circuit diagram of the detection circuit detecting the RC loading of a scan line.

FIG. 4A is a schematic circuit diagram of the detection circuit 22 detecting an RC (resistor-capacitor) loading of a scan line.

The detection circuit 22 can detect the RC loading of the scan line to determine the first switch time t1 and the second switch time t2. The detection circuit 22 will generate a time constant τ corresponding to the scan line according to its RC loading to determine the first switch time t1 and the second switch time t2. Herein, the time constant τ equals the product of the equivalent resistance and the equivalent capacitance of the scan line, i.e. "τ=R×C".

Figure 4B:
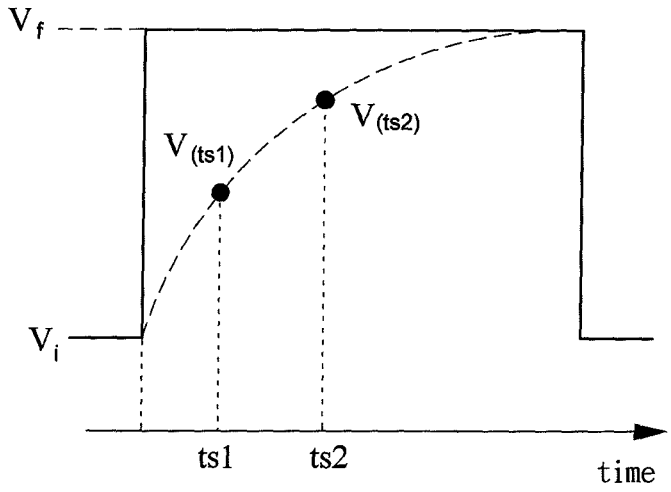
FIG. 4B is a schematic diagram of a detection signal.

Because the scan line can be regarded as the combination of an equivalent resistor R and an equivalent capacitor C, and besides, each scan line of the display apparatus 4 is connected to the same loading (pixels of the display panel 3), the detection circuit 22 can detect the RC loading of any scan line. During the detection, the detection circuit 22 can transmits at least one detection signal Ts to a scan line to detect the time constant τ of the scan line. As shown in FIG. 4B, the detection signal Ts can be, for example, a square wave with a high level voltage Vf (e.g. 20V) and a low level voltage Vi (e.g. 0V).

In other words, in order to determine the first switch time t1 and the second switch time t2, the detection circuit 22 transmits a detection signal Ts to a scan line at one or more times, such as the time ts1 or ts2 as shown in FIG. 4B. When the detection signal Ts is input to the scan line, a voltage V(ts1) (i.e. the voltage difference of the two ends of the capacitor C) can be detected at one end of the capacitor C at the time ts1, and a voltage V(ts2) can be also detected at the time ts2.

Figure 4C:
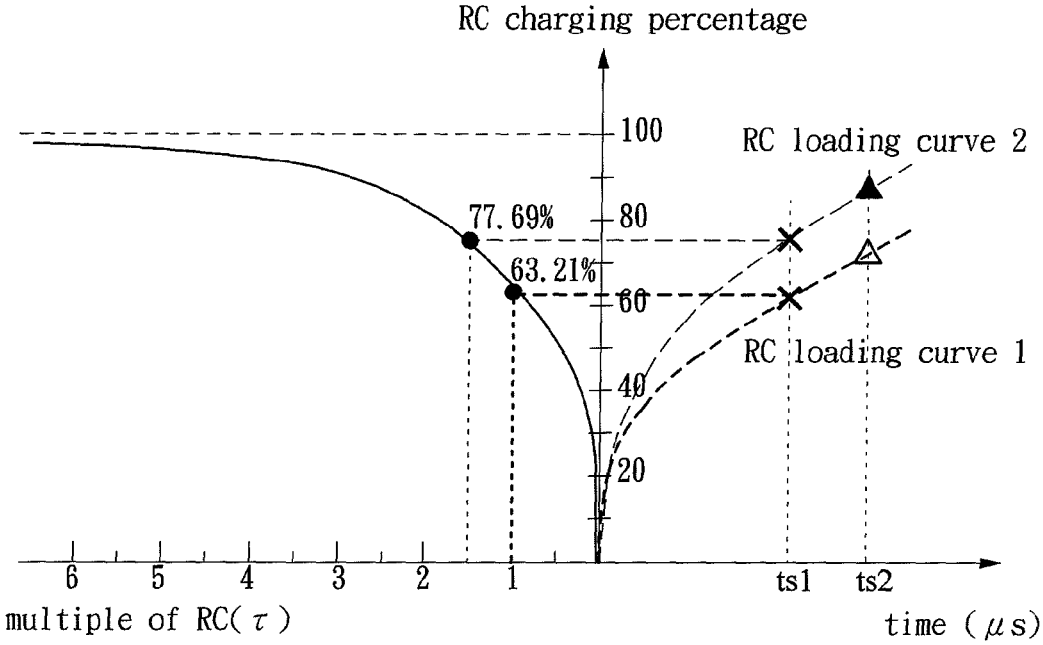
FIG. 4C is a schematic diagram of the RC charging curve.

FIG. 4C is a schematic diagram of the RC charging curve, in which the vertical axis is the RC charging percentage, the right side of the horizontal axis is time (μs), and the left side of the horizontal axis is the multiple of RC. Besides, the solid line on the left side of FIG. 4C means an ideal RC charging curve, which can be represented by an equation as follows:

$$V(t)=Vi+\Delta V(1-e(-t/\tau)),\ \Delta V=Vf-Vi=20\text{V},\ \tau=RC$$

The dotted lines on the right side of FIG. 4C mean the different RC loading curve 1 and RC loading curve 2, respectively.

For example, it is assumed that one scan line has an RC loading conforming to the RC loading curve 1 as shown in FIG. 4C. When the detection signal Ts is input to the scan line, the voltage difference of the two ends of the capacitor C is detected as V(ts1) at the time 10 μs. Then, the RC charging percentage can be obtained as 63.2% by using the equation: ΔV(ts1)=(V(ts1)−Vi)/(Vf−Vi), and then corresponded to the ideal RC charging curve that the one RC is derived from the X-coordinate. Therefore, the time constant τ of the scan line equals 10 μs (one RC).

For another example, it is assumed that another scan line has an RC loading conforming to the RC loading curve 2 as shown in FIG. 4C. When the detection signal Ts is input to the scan line, the voltage difference of the two ends of the capacitor C is detected as V(ts1) at the time 10 μs. Then, the RC charging percentage can be obtained as 77.7%, and then corresponded to the ideal RC charging curve that the 1.5 times of RC is derived from the X-coordinate. Accordingly, the equation "1.5*RC=10 μs" can be obtained. So, the time constant τ (1RC) of the scan line equals 6.67 μs (10 μs/1.5). Other cases can be deduced by analogy.

After the time constant τ of the scan line is derived, the first switch time t1 and the second switch time t2 can be set to a multiple of the time constant τ, and the multiple can be varied according to the size of the display panel 3. Besides, the first switch time t1 and the second switch time t2 can be determined according to the requirement of the amount of the charging time.

As shown in FIG. 2, the scan signal generating circuit 23 is electrically connected with the scan driving circuit 21 and the detection circuit 22. The scan signal generating circuit 23 can control the scan driving circuit 21 to output the scan driving signal SD. The scan signal generating circuit 23 determines the first precharge-level voltage P1 according to the first target-level voltage T1 and the first switch time t1, and determines the second precharge-level voltage P2 according to the second target-level voltage T2 and the second switch time t2. The first switch time t1 and the second switch time t2 can be set as the same or different. In the embodiment, the first switch time t1 and the second switch time t2 are the same for example.

As shown in FIG. 3, the scan driving signal SD for driving the display panel 3 includes the first precharge-level voltage P1, the first target-level voltage T1, the second precharge-level voltage P2, and the second target-level voltage T2 in sequence. At one time, the scan driving circuit 21 outputs one of the first precharge-level voltage P1, the first target-level voltage T1, the second precharge-level voltage P2, and the second target-level voltage T2.

The scan signal generating circuit 23 determines the first precharge-level voltage P1 and the second precharge-level voltage P2 according to the first target-level voltage T1, the second target-level voltage T2, and the first switch time t1 (and the second switch time t2) and based on a look up table. The look up table can be built in the scan signal generating circuit 23.

In order to determine the first precharge-level voltage P1 and the second precharge-level voltage P2, the first target-level voltage T1 and the second target-level voltage T2 can be determined and a multiple of the time constant τ can be determined according to the panel size and requirement. For example, as shown in the below Table 1, if the first target-level voltage T1 and the second target-level voltage T2 are respectively determined as 15V and −5V by referring to the gray level voltage, and the two times of the time constant τ is selected, the first precharge-level voltage P1 and the second precharge-level voltage P2 can be derived as 18.13V and −8.13V respectively. To be noted, when the multiple of the time constant τ is decreased, the first precharge-level voltage P1 becomes higher and the second precharge-level voltage P2 becomes lower. Therefore, the first target-level voltage T1, the second target-level voltage T2, the first switch time t1, and the second switch time t2 can be properly selected according to the design requirement, and then the first precharge-level voltage P1 and the second precharge-level voltage P2 can be derived by referring to the look up table.

TABLE 1

| Target-level voltage | | Multiple of | Precharge-level voltage | |
|---|---|---|---|---|
| T1 | T2 | the time constant | P1 | P2 |
| 15 | −5 | 0.5 | 45.83 | −35.83 |
| 15 | −5 | 0.6 | 39.33 | −29.33 |
| 15 | −5 | 0.7 | 34.73 | −24.73 |
| 15 | −5 | 0.8 | 31.32 | −21.32 |
| 15 | −5 | 0.9 | 28.70 | −18.70 |
| 15 | −5 | 1.0 | 26.64 | −16.64 |
| 15 | −5 | 1.5 | 20.74 | −10.74 |
| 15 | −5 | 2.0 | 18.13 | −8.13 |

Figure 5A:
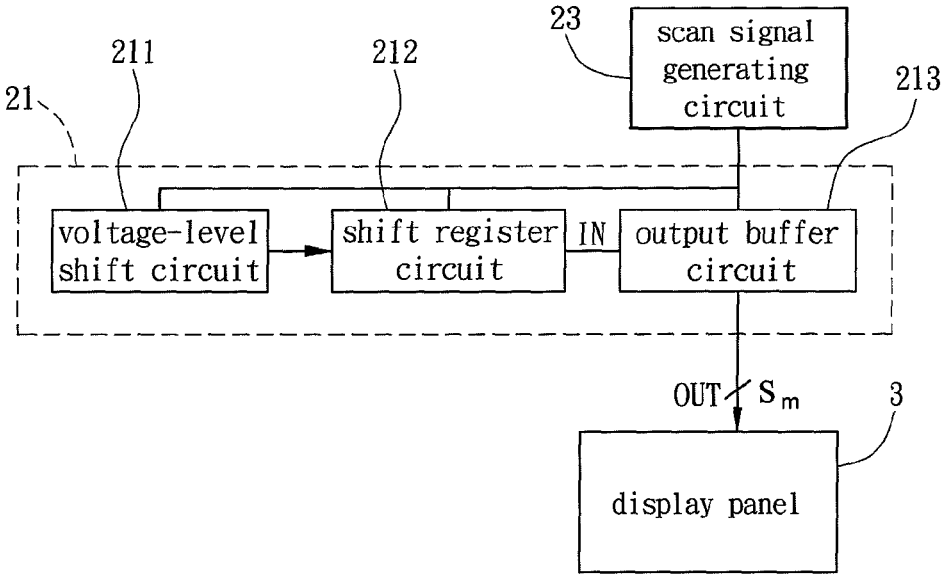
FIG. 5A is a schematic block diagram of the scan driving circuit and the scan signal generating circuit.
Figure 5B:
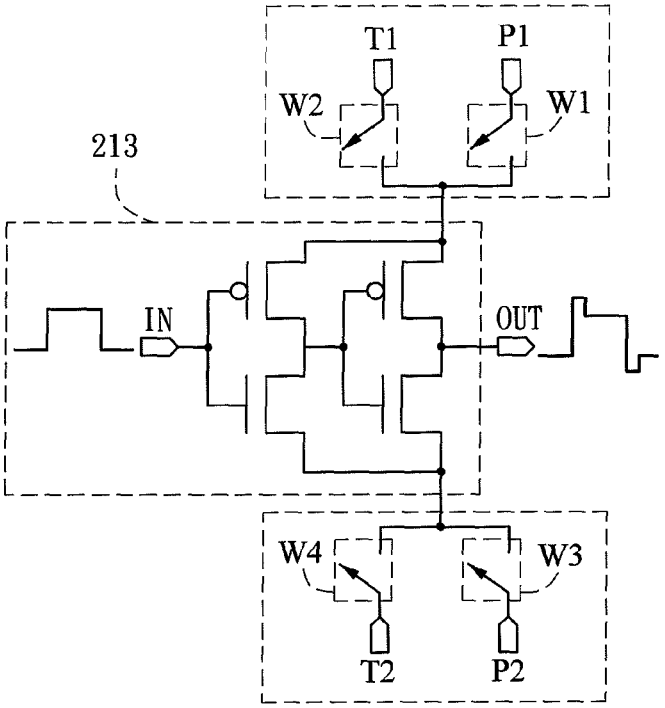
FIG. 5B is a schematic circuit diagram of a partial circuit as shown in FIG. 5A.

FIG. 5A is a schematic block diagram of the scan driving circuit 21 and the scan signal generating circuit 23, and FIG. 5B is a schematic circuit diagram of a partial circuit as shown in FIG. 5A.

As shown in FIG. 5A, the scan driving circuit 21 can include a voltage-level shift circuit 211, a shift register circuit 212, and a output buffer circuit 213. The voltage-level shift circuit 211 is electrically connected with the shift register circuit 212 and the scan signal generating circuit 23. The voltage-level shift circuit 211 can shift the originally lower level voltage, such as 3V/0V or 5V/0V, to the higher turn-on voltage for turning on the pixel switch and further lower turn-off voltage for turning off the pixel switch. The shift register circuit 212 is electrically connected with the output buffer circuit 213 and the scan signal generating circuit 23. The shift register circuit 212 can receive the signal output by the voltage-level shift circuit 211, and output the signal to the output buffer circuit 213 at the proper timing controlled by the timing controller (not shown).

The scan signal generating circuit 23 can output the first precharge-level voltage P1, the second precharge-level voltage P2, the first target-level voltage T1, the second target-level voltage T2, the first switch time t1, and the second switch time t2 to the scan driving circuit 21. For the clear illustration, the output buffer circuit 213 as shown in FIG. 5B is just instanced as a two stages inverter, and the real circuit and the stage number can be designed according to the requirement of the display panel 3, so the detailed descriptions are omitted here. To be noted, the scan signal generating circuit 23 and the detection circuit 22 can be integrated with the timing control circuit or the scan driving circuit 21.

As shown in FIG. 5B, the scan signal generating circuit 23 outputs the first precharge-level voltage P1, the first target-level voltage T1, the second precharge-level voltage P2, and the second target-level voltage T2 to the output buffer circuit 213 at the different time, so that the scan driving signal SD output by the scan driving circuit 21 for driving the display panel 3 can have different levels at different times.

As shown in FIGS. 3 and 5B, in the beginning, the scan signal generating circuit 23 can turn on the switch W1 to input the first precharge-level voltage P1 to the output buffer circuit 213, so that the scan driving signal SD can have the first precharge-level voltage P1 (higher than the first target-level voltage T1). After the first switch time t1, the scan signal generating circuit 23 turns on the switch W2 (also turns off the switch W1) to input the first target-level voltage T1 to the output buffer circuit 213, so that the scan driving signal SD can be switched from the first precharge-level voltage P1 to the first target-level voltage T1. Then, after the time Th (derived by subtracting the first switch time t1 from the scan time St), the scan signal generating circuit 23 can turn on the switch W3 (also turn off the switch W2) to input the second precharge-level voltage P2 to the output buffer circuit 213, so that the scan driving signal SD can be switched from the first target-level voltage T1 to the second precharge-level voltage P2 (lower than the second target-level voltage T2). Then, after the second switch time t2, the scan signal generating circuit 23 can turn on the switch W4 (also turn off the switch W3) to input the second target-level voltage T2 to the output buffer circuit 213, so that the scan driving signal SD can be switched from the second precharge-level voltage P2 to the second target-level voltage T2. Accordingly, the corresponding scan driving signal SD can be input to the scan line Sm to drive the display panel 3.

As mentioned above, the scan line is pre-charged by the higher first precharge-level voltage P1 and then switched to the first target-level voltage T1 after the first switch time t1, and shut off by the lower second precharge-level voltage P2 and then switched to the second target-level voltage T2 after the second switch time t2. Therefore, the scan driving signal can be driven rapidly to the target-level voltage, reducing the charging and discharging time of the scan line's loading and diminishing the scan line's signal delay. Besides, because the scan driving signals SD for driving the pixels of the display panel 3 is not fixed to a level as high as the prior art, the power consumption and the stress effect of the pixel switch devices (such as transistors) can be decreased in the display apparatus 4 of the embodiment.

Figure 6:
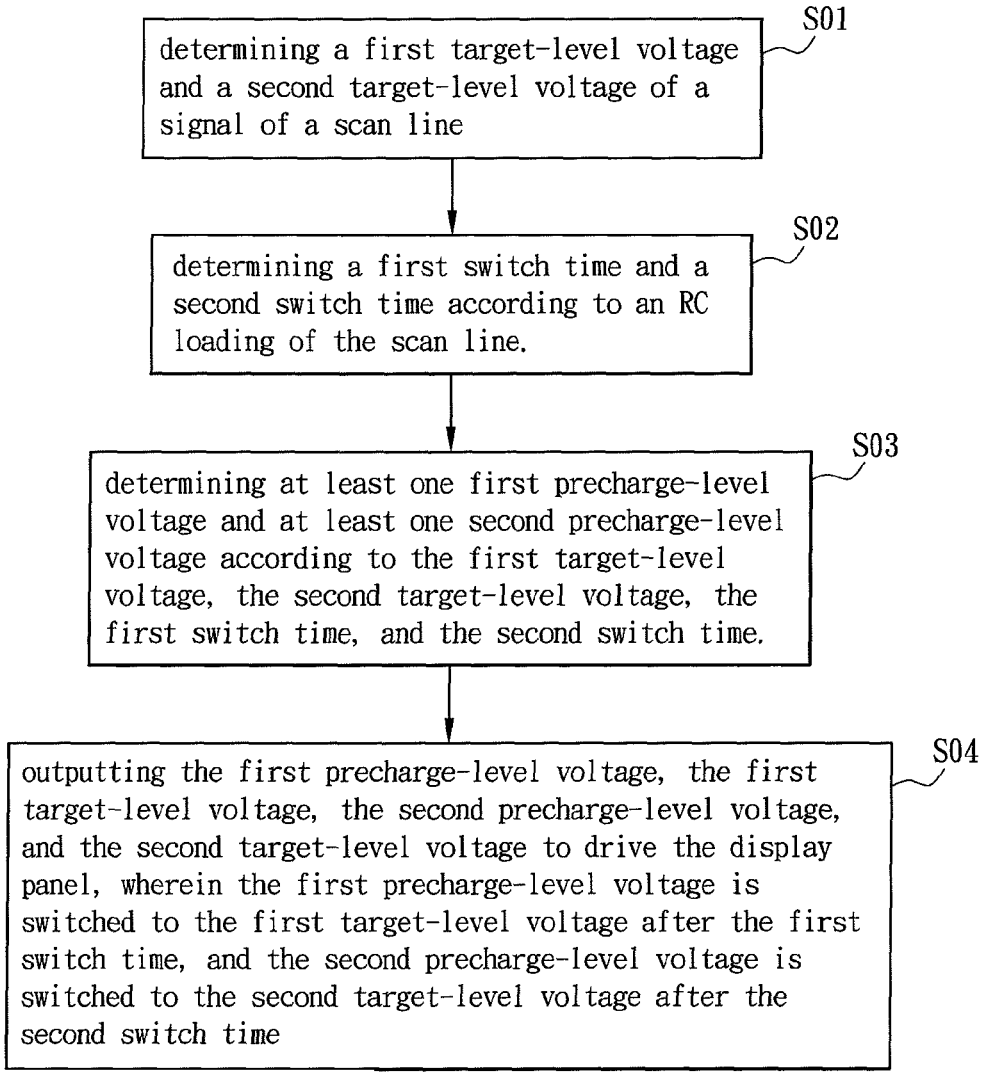
FIG. 6 is a flow chart of a display driving method of the invention.

FIG. 6 is a flow chart of a display driving method according to a preferred embodiment of the invention. In the display driving method of the embodiment, a display panel 3 is driven by at least one scan line, and as shown in FIG. 2, the display panel 3 is driven by a plurality of scan lines Sm. As shown in FIG. 6, the display driving method includes the steps S01 to S04.

The step S01 is to determine a first target-level voltage T1 and a second target-level voltage T2 of a signal of a scan line. Herein, the first target-level voltage T1 and the second target-level voltage T2 are determined according to the gray level voltages driving the pixels of the display panel 3.

The step S02 is to determine a first switch time t1 and a second switch time t2 according to an RC loading of the scan line.

As shown in FIGS. 4A to 4C, a detection signal Ts is input to a scan line to detect the time constant $\tau$ of the scan line. Besides, the time constant $\tau$ of the scan line is generated according to the RC loading of the scan line. The first switch time t1 and the second switch time t2 can be determined according to the time constant $\tau$. The first switch time t1 and the second switch time t2 can be the same or different, and herein they are instanced as the same.

The step S03 is to determine at least one first precharge-level voltage P1 and at least one second precharge-level voltage P2 according to the first target-level voltage T1, the second target-level voltage T2, the first switch time t1, and the second switch time t2.

As shown in FIG. 3, a single first precharge-level voltage P1 and a single second precharge-level voltage P2 are instanced. Besides, the first precharge-level voltage P1 and the second precharge-level voltage P2 are determined by referring to a look up table (such as the above chart 1). The first precharge-level voltage P1 is higher than the first target-level voltage T1, and the second precharge-level voltage P2 is lower than the second target-level voltage T2.

The step S04 is to output the first precharge-level voltage P1, the first target-level voltage T1, the second precharge-level voltage P2, and the second target-level voltage T2 to drive the display panel, wherein the first precharge-level voltage P1 is switched to the first target-level voltage T1 after the first switch time t1, and the second precharge-level voltage P2 is switched to the second target-level voltage T2 after the second switch time t2.

As shown in FIG. 3, the scan driving signal SD output by the scan driving circuit 21 can include the first precharge-level voltage P1, the first target-level voltage T1, the second precharge-level voltage P2, and the second target-level voltage T2 in sequence, Because the features of the display driving method of the embodiment have been clearly illustrated as the above embodiments, the detailed descriptions are omitted here.

In summary, in the display driving method, the driving module and the display apparatus of the invention, a first switch time and a second switch time are determined according to the RC loading of the scan line. Besides, a first precharge-level voltage and a second precharge-level voltage are determined according to the first target-level voltage, the second target-level voltage, the first switch time, and the second switch time. Then, the first precharge-level voltage, the first target-level voltage, the second precharge-level voltage, and the second target-level voltage are output to drive the display panel. The first precharge-level voltage is switched to the first target-level voltage after the first switch time, and the second precharge-level voltage is switched to the second target-level voltage after the second switch time. Accordingly, the scan driving signal can be driven rapidly to the target-level voltage, reducing the charging and discharging time of the scan line's loading and diminishing the scan line's signal delay. Besides, because the scan driving signals for driving the pixels of the display panel are not fixed to a level as high as the prior art, the power consumption and the stress effect of the pixel switch devices (such as transistors) can be decreased in the display apparatus of the invention.

Although the invention has been described with reference to specific embodiments, this description is not meant to be construed in a limiting sense. Various modifications of the disclosed embodiments, as well as alternative embodiments, will be apparent to persons skilled in the art. It is, therefore, contemplated that the appended claims will cover all modifications that fall within the true scope of the invention.

What is claimed is:

1. A display driving method for driving a display panel by at least one scan line, comprising the steps of:

determining a first target-level voltage and a second target-level voltage of a signal of the scan line;

determining a first switch time and a second switch time according to an RC loading of the scan line;

determining at least one first precharge-level voltage and at least one second precharge-level voltage according to the first target-level voltage, the second target-level voltage, the first switch time, and the second switch time; and outputting the first precharge-level voltage, the first target-level voltage, the second precharge-level voltage, and the second target-level voltage to drive the display panel, wherein the first precharge-level voltage is switched to the first target-level voltage after the first switch time, and the second precharge-level voltage is switched to the second target-level voltage after the second switch time, wherein the first target-level voltage and the second target-level voltage are determined according to gray level voltages driving the pixels of the display panel.

2. The display driving method as recited in claim 1, wherein the first target-level voltage is higher than the highest gray level voltage by at least one threshold voltage, and the second target-level voltage is lower than the lowest gray level voltage by at least one threshold voltage.

3. The display driving method as recited in claim 1, wherein the first precharge-level voltage is higher than the first target-level voltage, and the second precharge-level voltage is lower than the second target-level voltage.

4. The display driving method as recited in claim 1, wherein a time constant of the scan line is generated according to the RC loading of the scan line, to determine the first switch time and the second switch time.

5. The display driving method as recited in claim 1, wherein one of the first precharge-level voltage, the first target-level voltage, the second precharge-level voltage, and the second target-level voltage is output at one time.

6. A driving module for driving a display panel by at least one scan line, comprising:

a scan driving circuit outputting a scan driving signal to drive the display panel, wherein the scan driving signal has at least one first precharge-level voltage and a first target-level voltage, and the first precharge-level voltage is switched to the first target-level voltage after a first switch time;

a detection circuit detecting an RC loading of the scan line to determine the first switch time; and a scan signal generating circuit electrically connected with the scan driving circuit and the detection circuit and controlling the scan driving circuit to output the scan driving signal, wherein the scan signal generating circuit determines the first precharge-level voltage according to the first target-level voltage and the first switch time, wherein the first target-level voltage is determined according to gray level voltages driving the pixels of the display panel, and the first target-level voltage is higher than the highest gray level voltage by a at least one threshold voltage.

7. The driving module as recited in claim 6, wherein the detection circuit generates a time constant of the scan line according to the RC loading of the scan line to determine the first switch time.

8. The driving module as recited in claim 6, wherein the scan driving signal further includes at least one second precharge-level voltage and a second target-level voltage, and the second precharge-level voltage is switched to the second target-level voltage after a second switch time.

9. The driving module as recited in claim 8, wherein the scan signal generating circuit determines the second precharge-level voltage according to the second target-level voltage and the second switch time.

10. The driving module as recited in claim 8, wherein the second target-level voltage is lower than the lowest gray level voltage by at least one threshold voltage, the highest gray level voltage is the highest gray level voltage of a frame, and the lowest gray level voltage is the lowest gray level voltage of the frame.

11. The driving module as recited in claim 8, wherein the first precharge-level voltage is higher than the first target-level voltage, and the second precharge-level voltage is lower than the second target-level voltage.

12. A display apparatus, comprising:

a display panel; and a driving module driving the display panel by at least one scan line and comprising:

a scan driving circuit outputting a scan driving signal to drive the display panel, wherein the scan driving signal has at least one first precharge-level voltage and a first target-level voltage, and the first precharge-level voltage is switched to the first target-level voltage after a first switch time;

a detection circuit detecting an RC loading of the scan line to determine the first switch time; and a scan signal generating circuit electrically connected with the scan driving circuit and the detection circuit and controlling the scan driving circuit to output the scan driving signal, wherein the scan signal generating circuit determines the first precharge-level voltage according to the first target-level voltage and the first switch time, wherein the first target-level voltage is determined according to gray level voltages driving the pixels of the display panel, and the first target-level voltage is higher than the highest gray level voltage by at least one threshold voltage.

13. The display apparatus as recited in claim 12, wherein the detection circuit generates a time constant of the scan line according to the RC loading of the scan line, to determine the first switch time.

14. The display apparatus as recited in claim 12, wherein the scan driving signal further includes at least one second precharge-level voltage and a second target-level voltage, and the second precharge-level voltage is switched to the second target-level voltage after a second switch time.

15. The display apparatus as recited in claim 14, wherein the scan signal generating circuit determines the second precharge-level voltage according to the second target-level voltage and the second switch time.

16. The display apparatus as recited in claim 14, wherein the second target-level voltage is lower than the lowest gray level voltage by at least one threshold voltage, the highest gray level voltage is the highest gray level voltage of a frame, and the lowest gray level voltage is the lowest gray level voltage of the frame.

17. The display apparatus as recited in claim 14, wherein the scan driving circuit outputs one of the first precharge-level voltage, the first target-level voltage, the second precharge-level voltage, and the second target-level voltage at one time.

18. The display apparatus as recited in claim 14, wherein the first precharge-level voltage is higher than the first target-level voltage, and the second precharge-level voltage is lower than the second target-level voltage.

* * * * *